US005199908A

United States Patent [19]

Sucheski

[11] Patent Number: 5,199,908

[45] Date of Patent: Apr. 6, 1993

[54] ELECTRICAL CONTACT

[75] Inventor: Matthew M. Sucheski, Harrisburg, Pa.

[73] Assignee: AMP Incorporated, Harrisburg, Pa.

[21] Appl. No.: 914,912

[22] Filed: Jul. 16, 1992

[51] Int. Cl.[5] ..... H01R 13/41

[52] U.S. Cl. ..... 439/751; 439/84

[58] Field of Search ..... 439/81, 84, 751, 873

[56] References Cited

U.S. PATENT DOCUMENTS

| | | | |
|---|---|---|---|
| 2,958,065 | 10/1960 | Flanagan | 339/17 |
| 3,545,080 | 12/1970 | Evans | 29/629 |
| 3,777,303 | 12/1973 | McDonough | 339/258 R |
| 3,975,078 | 8/1976 | Ammon | 339/221 M |
| 4,076,356 | 2/1978 | Tamburro | 439/873 H |
| 4,381,134 | 4/1983 | Anselmo | 439/751 X |
| 4,867,691 | 9/1989 | Eck | 439/82 |
| 4,878,851 | 11/1989 | Mullen | 439/83 |
| 4,934,967 | 6/1990 | Marks et al. | 439/856 |
| 5,055,055 | 10/1991 | Bakker | 439/78 |
| 5,083,927 | 1/1992 | Herard et al. | 439/80 |

*Primary Examiner*—Eugene F. Desmond

[57] ABSTRACT

An electrical contact (10) includes a central retention portion (16) adapted for insertion in a printed circuit board hole (38). The retention portion (16) includes first and second beam members (22, 24) and first and second collar sections (18, 20) which are rolled into a substantially cylindrical shape about an axis parallel to the longitudinal axis of the beam members. The length of the beam members is at least as great as the thickness of the printed circuit board (40). The unstressed diameter of the substantially cylindrical retention portion is greater than the diameter of the circuit board hole (38). The retention portion (16) is formed with gaps (42, 44) so that it can be compressed for insertion into the hole (38). Since the spacing between the collar sections (18, 20) is at least as great as the thickness of the circuit board (40), the collar sections are on opposite sides of the circuit board outside the hole when the retention portion is inserted in the hole. Accordingly, the collar sections (18, 20) are free to expand so that the beam members (22, 24) engage the interior wall of the hole (38) to provide mechanical and electrical connections thereto without requiring the use of a soldering process.

9 Claims, 5 Drawing Sheets

ELECTRICAL CONTACT

BACKGROUND OF THE INVENTION

This invention relates to electrical contacts and, more particularly, to such a contact which is adapted for insertion and retention in a printed circuit board hole without the requirement of a soldering process. In addition, the present invention is related to such a contact arranged so that an array of stacked printed circuit boards may be electrically interconnected.

When an electrical connector assembly is mounted to a printed circuit board, it is necessary to provide electrical interconnections between the electrical contacts within the connector assembly and wiring traces on and within the printed circuit board. It is conventional to provide an array of plated through holes in the printed circuit board which accept respective contacts therein. The plating in each hole is suitably electrically connected to an appropriate wiring trace. It is further conventional that a soldering process be utilized to electrically and mechanically join the contacts to the walls of the respective holes. It would be desirable to be able to eliminate the soldering process.

It is therefore a primary object of the present invention to provide an electrical contact which may be electrically and mechanically connected to the wall of a circuit board plated through hole without the necessity for soldering the contact in the hole.

There are numerous applications where it is desired to stack printed circuit boards and provide electrical interconnections therebetween. It is therefore a further object of this invention to provide an electrical contact of the type described which is arranged so that it may be electrically interconnected with a similar contact at either of its ends in a stacked array of printed circuit boards.

SUMMARY OF THE INVENTION

The foregoing and additional objects are attained in accordance with the principles of this invention by providing an electrical contact for insertion and retention in a printed circuit board circular hole. The contact includes a retention portion comprising first and second collar sections and first and second beam members each joining the first and second collar sections. The first and second collar sections are formed substantially as segments of respective cylinders of larger diameter than the diameter of the circuit board hole and are resiliently compressible to pass through the hole. The first and second beam members each have a length at least as great as the thickness of the circuit board. Accordingly, the first collar segment can be passed through the circuit board hole when it is resiliently compressed so that the collar sections are on opposite sides of the circuit board and outside the circuit board hole. The subsequent relaxation and expansion of the collar sections causes the first and second beam members to engage the wall of the hole to retain the contact therein.

In accordance with an aspect of this invention, the first collar section is formed such that its leading edge when it is passed through the circuit board hole is slanted transverse to the direction of insertion into the circuit board hole. Accordingly, the first collar section is resiliently compressed upon insertion into the circuit board hole.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 5:
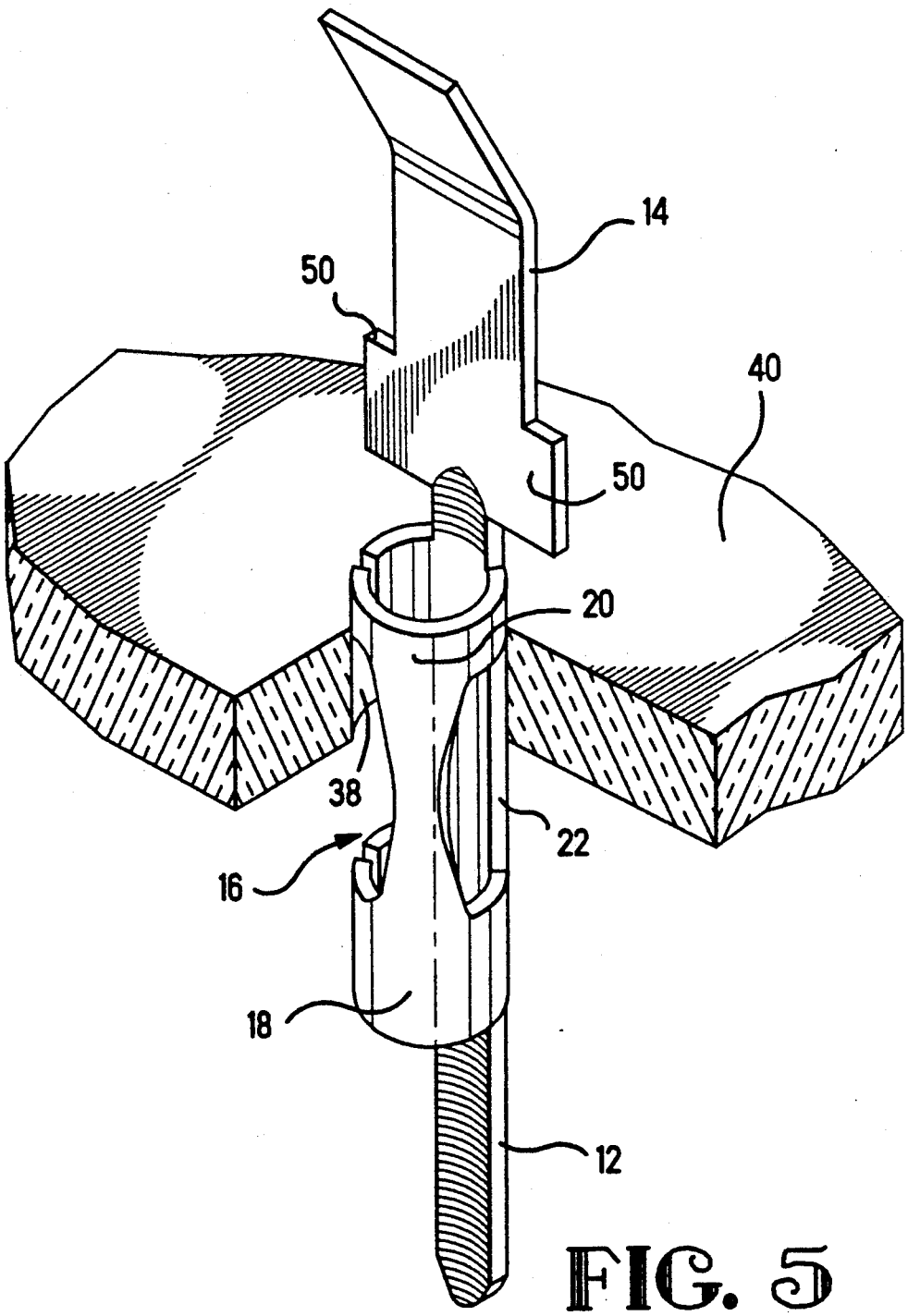
FIG. 5 is a partially cut away perspective view showing an electrical contact constructed according to this invention inserted in a printed circuit board hole.

Referring to the drawings, an electrical contact 10 constructed according to this invention includes a terminal portion 12, which is preferably relatively rigid, and a spring contact terminal portion 14 extending in opposite directions from a central retention portion 16. According to this invention, the retention portion 16 includes a first collar section 18 and a second collar section 20. Preferably, the contact 10 is formed from flat sheet stock material and is initially in the form shown in FIG. 3 (for a first embodiment). The retention portion 16 also includes a first beam member 22 and a second beam member 24, each of which joins the first collar section 18 and the second collar section 20. The first and second collar sections 18, 20 extend from a first edge 26 of the first beam member 22 and the second beam member 24 joins the first and second collar sections 20, 22 between the first edge 26 and the distal ends 28, 30 of the first and second collar sections 20, 22, respectively. Thus, an opening 32 is formed which is bounded by the first collar section 18, the first beam member 22, the second collar section 20 and the second beam member 24. Also, the first and second collar sections 18, 20 extend beyond the second beam member 24 from the first edge 26 toward their distal ends 28, 30, respectively. Further, as is clear from FIG. 3, the first collar section 18 is formed with a first edge 34 which is substantially orthogonal to the edge 26 and a second edge 36 which is at an angle to the edge 34 so that the first collar section 18 is wider where it joins the edge 26 than at its distal end 28. The reason for this slant will be discussed in full detail hereinafter. As previously discussed, the contact 10 is adapted for insertion and retention within a circular hole 38 of a printed circuit board 40 (FIG. 5). According to this invention, the length of each of the beam members 22, 24 is at least as great as the thickness of the printed circuit board 40. The reason for this will become apparent from the following description.

Figure 1:
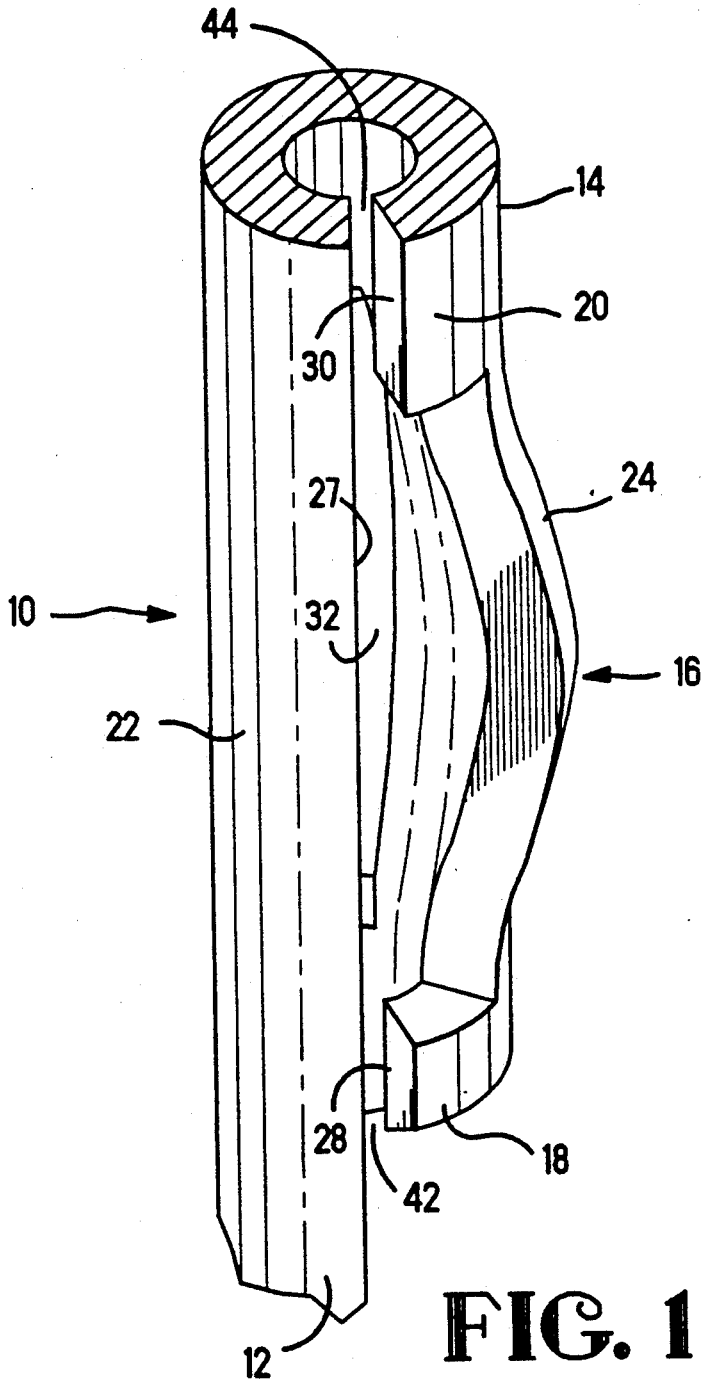
FIG. 1 is a perspective view of the retention section of an electrical contact constructed according to this invention.
Figure 2:
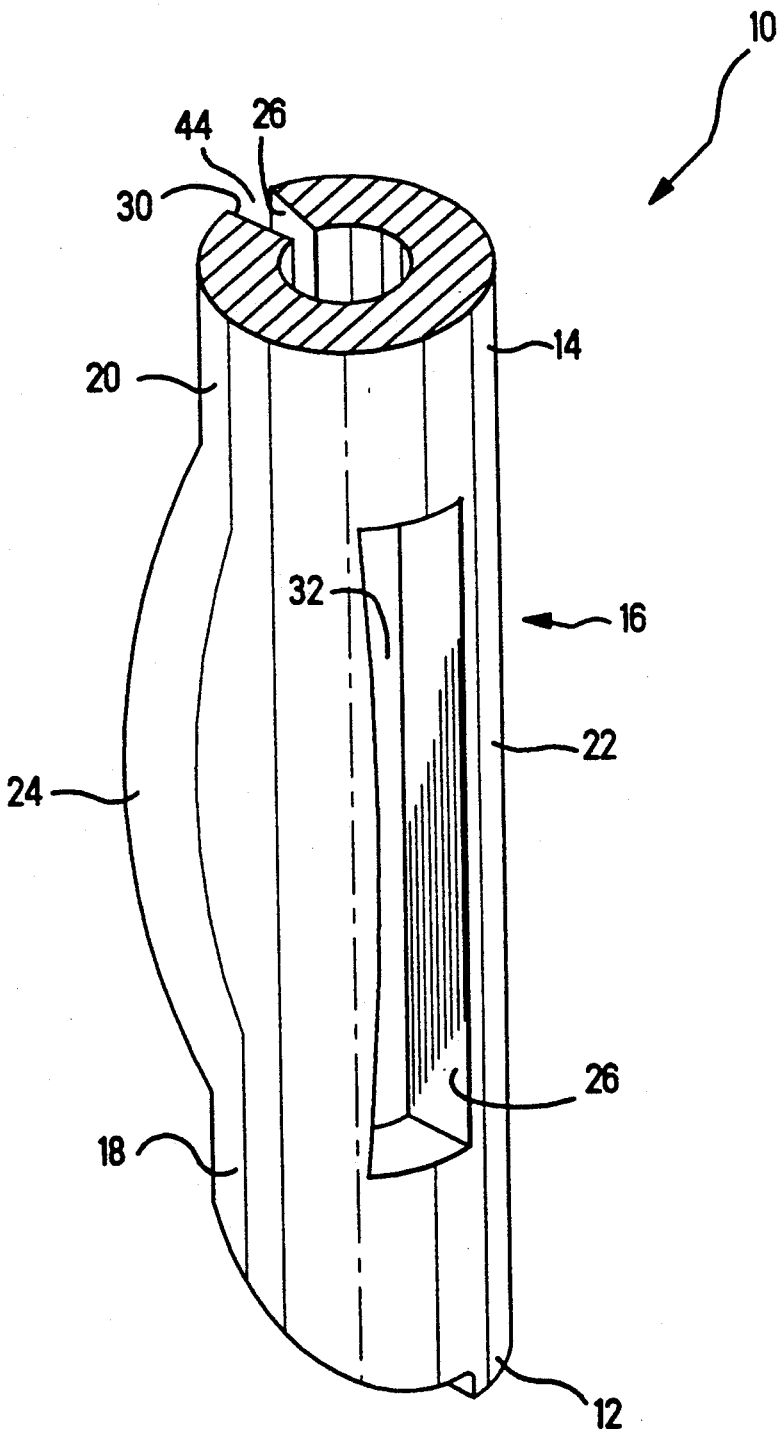
FIG. 2 is a perspective view of the retention section shown in FIG. 1 when viewed in a direction substantially opposite to the viewing direction of FIG. 1.
Figure 3:
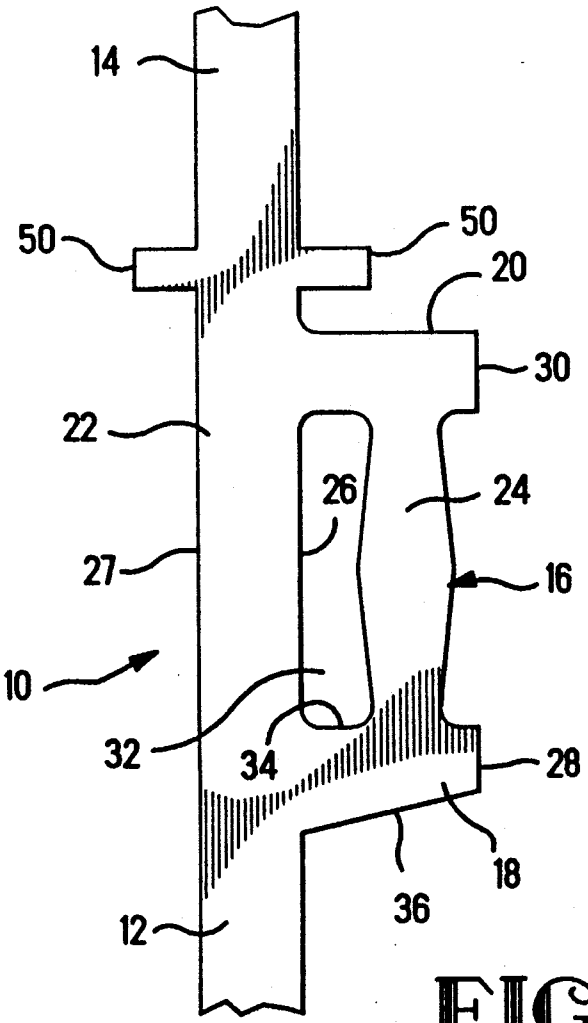
FIG. 3 illustrates the shape of a blank of a first embodiment of a retention section for an electrical contact constructed according to this invention.

The contact 10 is formed into its final configuration from the flat blank shown in FIG. 3 by rolling the retention portion 16 into a substantially cylindrical shape about an axis parallel to the longitudinal axis of the first beam member 22. During such formation, a gap 42 is maintained between the distal end 28 of the first collar section 18 and the second edge 27 of the first beam member 22 and a gap 44 is maintained between the distal end 30 of the second collar section 20 and the edge 27, as shown in FIGS. 1 and 2. The dimensions of the collar sections 18, 20 and the gaps 42, 44 are chosen so that after the retention portion 16 is rolled into the substantially cylindrical form shown in FIGS. 1 and 2, the diameters of the collar sections 18 and 20 are larger than the diameter of the circuit board hole 38, but the collar sections 18 and 20 can be compressed by reducing the gaps 42 and 46 so that, when compressed, the diameters of the collar sections 18 and 20 are less than the diameter of the circuit board hole 38. Thus, the collar sections 18 and 20 can be compressed to allow the retention portion 16 of the contact 10 to be inserted in the circuit board hole 38. As previously mentioned, the lengths of the beam members 22 and 24 are at least as great as the thickness of the printed circuit board 40. Accordingly, the collar sections 18 and 20 are on opposite sides of the board 40 and outside the hole 38 after the retention portion 16 is inserted in the hole 38. This serves two purposes. First, the circuit board 40 does not interfere with the resilient expansion of the collar sections 18 and 20. This expansion results in a spring force which causes the first and second beam members 22 and 24 to engage the wall of the hole 38. This engagement provides both an electrical and a mechanical connection to the wall of the hole 38, and eliminates the requirement of a soldering process. Second, the ends of the collar sections 18 and 20 beyond the second beam member 24 can straddle the board 40 outside the confines of the hole 38 to interfere with an unintended removal of the contact 10 from the hole 38.

As best shown in FIG. 1, the second beam member 26 is bowed outwardly away from the first beam member 22. This is achieved during the rolling process by rolling the collar sections 18 and 20 slightly toward each other, rather than perfectly parallel to each other. This bowing of the second beam member 24 aids in the retention of the contact 10 in the hole 38. The slant of the edge 36 aids in the insertion of the contact 10 in the hole 38 without the use of any special tools to compress the retention portion 16. Thus, after the terminal portion 12 is inserted through the hole 38, a portion of the first collar section 18 can extend into the hole 38 without compression of the retention portion 16. Continued insertion provides the force necessary to compress the retention portion 16, as determined by the slant angle of the edge 36.

Figure 6:
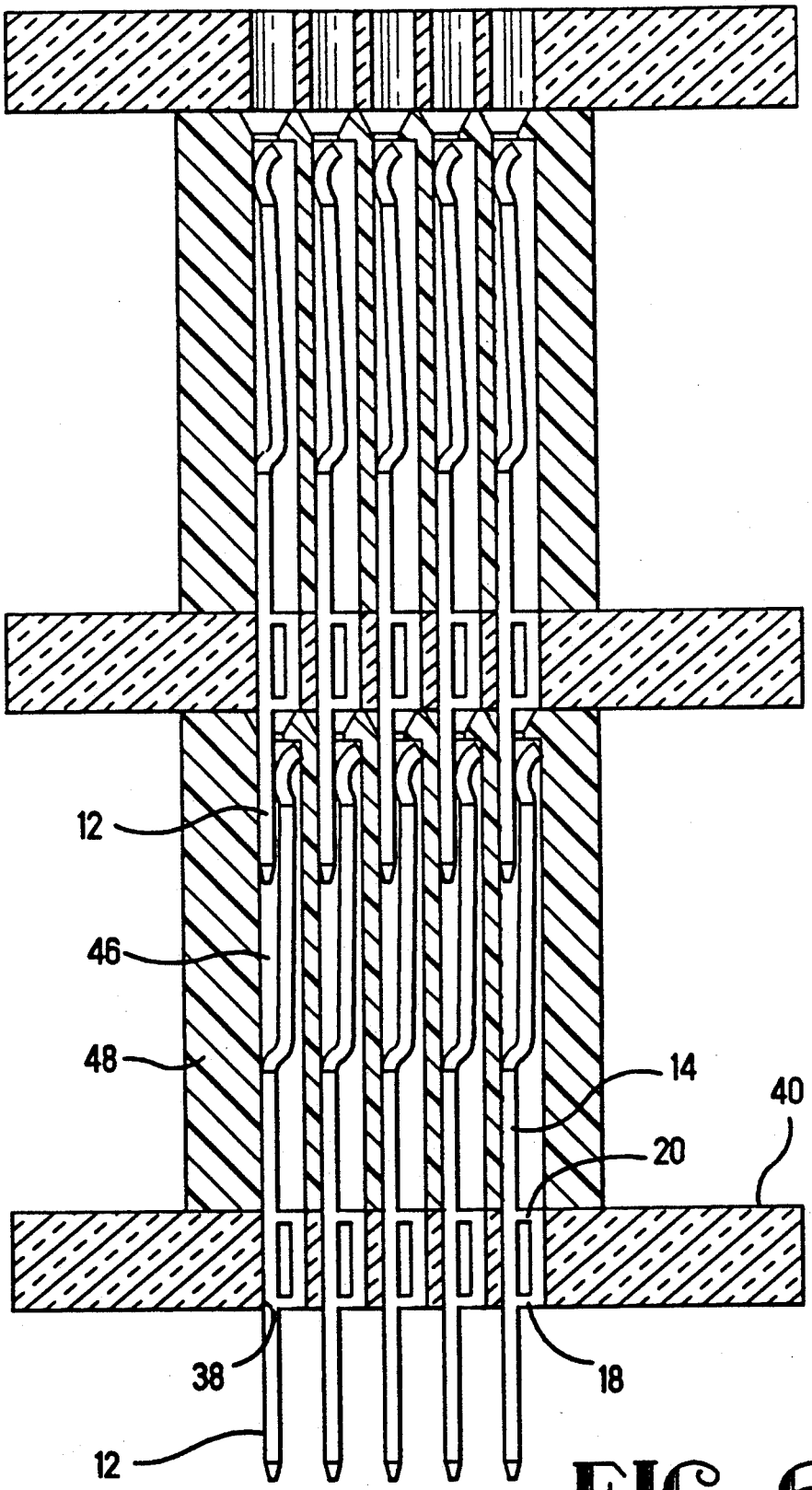
FIG. 6 is a view showing how electrical contacts constructed according to this invention may be arranged in a stack of alternating electrical connector assemblies and printed circuit boards.

As is conventional, the contact 10 is installed within an electrical connector. Typically, such a connector includes a housing having an array of passageways therethrough, with each of the passageways holding a respective contact. For the contact 10, as best shown in FIG. 6, only the spring contact terminal portion 14 is installed within a passageway 46 of a connector housing 48. The spring contact terminal portion 14 is illustratively formed with a pair of outwardly extending tabs 50 which aid in the retention of the contact 10 in the connector housing 48.

The contact 10 according to this invention is particularly adapted for use with a stacked array of printed circuit boards which are to be electrically interconnected. As shown in FIG. 6, with a spring contact terminal portion 14 installed within a passageway 46 of a connector housing 48 mounted to a printed circuit board 40, a terminal portion 12 of another contact 10 which extends downwardly from an upper circuit board and connector can extend into the passageway 46 and engage the spring contact terminal portion 14, thereby interconnecting traces on the stacked circuit boards.

Figure 4:
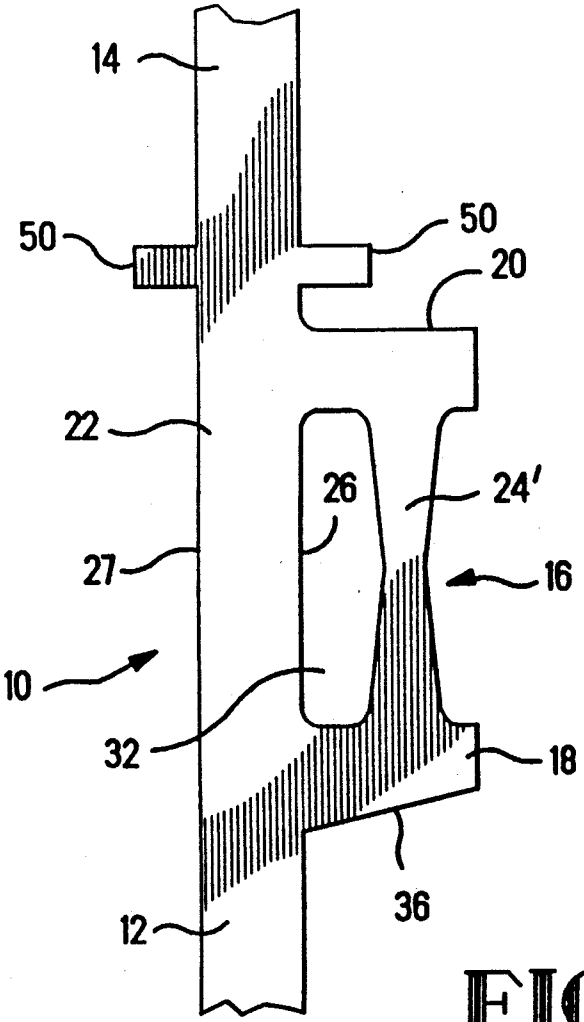
FIG. 4 illustrates the shape of a blank of a second embodiment of a retention section for an electrical contact constructed according to this invention.

As shown in FIG. 3, in a first embodiment of the contact 10, the second beam member 24 is shaped to taper outwardly from where it joins the collar sections 18 and 20 so that it is wider at its middle than it is at its ends. In a second embodiment of the contact 10 shown in FIG. 4, the second beam member 24' is shaped to taper inwardly from where it joins the collar sections 18 and 20 so that it is narrower at its middle than it is at its ends. Alternatively, a uniform width second beam member may also be utilized, and other shapes are also possible. FIGS. 3 and 4 also illustrate that the rigid terminal portion 12 and the spring contact terminal portion 14 are continuations of the first beam member 22. It will be appreciated that variations to the disclosed contact 10 may have the terminal portion 12 and the spring contact terminal portion 14 offset from, but parallel to, the first beam member 22.

Accordingly, there has been disclosed an electrical contact adapted for insertion and retention in a printed circuit board hole without the requirement of a soldering process. While illustrative embodiments have been disclosed herein, it will be appreciated that various modifications and adaptations to the disclosed embodiments are possible, and it only intended that this invention be limited by the scope of the appended claims.

I claim:

1. An electrical contact (10) for insertion and retention in a circular hole (38) which extends through a printed circuit board (40), said contact including a retention portion (16) comprising:

first and second collar sections (18, 20); and first and second beam members (22, 24) each joining said first and second collar sections;

wherein said first and second collar sections are formed substantially as segments of respective cylinders of larger diameter than the diameter of said circuit board hole, said first and second collar sections being resiliently compressible to pass through said hole, said first and second beam members each having a length at least as great as the thickness of said circuit board;

whereby said first collar section can be passed through said circuit board hole when said collar sections are resiliently compressed so that said collar sections are on opposite sides of said circuit board and outside said circuit board hole, and the subsequent relaxation and expansion of said collar sections causes said first and second beam members to engage the wall of said hole to retain said contact therein.

2. The contact according to claim 1 wherein said first collar section is formed such that its leading edge (36) when it is passed through said circuit board hole is slanted transverse to the direction of insertion into said circuit board hole, whereby said first collar section is resiliently compressed upon insertion into said circuit board hole.

3. The contact according to claim 1 further including:

a terminal portion (12) extending parallel to said first beam member (22) and beyond said first collar section (18); and a spring contact terminal portion (14) extending parallel to said first beam member (22) and beyond said second collar section (20);

said spring contact terminal portion being adapted for containment within a passageway (46) of a connector (48) mounted to said printed circuit board (40) so that said spring contact terminal portion can engage a terminal portion of another contact of another connector and printed circuit board stacked in superposition to said printed circuit board.

4. The contact according to claim 3 wherein said terminal portion (12) and said spring contact terminal portion (14) are each a continuation of said first beam member (22).

5. The contact according to claim 1 wherein said contact is formed from flat sheet stock material with said first and second collar sections (18, 20) extending from a first edge (26) of said first beam member (22), said second beam member (24) joining said first and second collar sections between said first edge and the distal ends (28, 30) of said first and second collar sections so that an opening (32) is formed which is bounded by said first and second beam members and said first and second collar sections, said first and second collar sections extending beyond said second beam member from said first edge, and wherein when said first and second collar sections are formed into substantially cylindrical segments there remain gaps (42, 44) between the distal ends of said first and second collar sections and a second edge (27) of said first beam member opposite said first edge (26), said gaps having sufficient width so that compression of said collar sections allows insertion of said retention portion into said circuit board hole.

6. The contact according to claim 5 wherein said first collar section (18) is formed with a first edge (34) orthogonal to said first beam member first edge (26) and a second edge (36) at an angle to said first collar section first edge (26) so that said first collar section is wider where it joins said first beam member first edge than it is at its distal end (28), whereby when said first collar section enters said circuit board hole (38) it is resiliently compressed.

7. The contact according to claim 5 wherein when said first and second collar sections (18, 20) are formed into substantially cylindrical segments, said second beam member (24) bows away from said first beam member (22).

8. The contact according to claim 1 wherein said second beam member (24') tapers inwardly from where it joins said first and second collar sections (18, 20) so that it is narrower at its middle than it is at its ends where it joins said first and second collar sections.

9. The contact according to claim 1 wherein said second beam member (24) tapers outwardly from where it joins said first and second collar sections (18, 20) so that it is wider at its middle than it is at its ends where it joins said first and second collar sections.

* * * * *